US009814362B2

(12) United States Patent
Romero

(10) Patent No.: US 9,814,362 B2
(45) Date of Patent: Nov. 14, 2017

(54) SHOP VAC

(71) Applicant: NORCO INDUSTRIES, INC., Compton, CA (US)

(72) Inventor: Jeff Romero, Middlebury, IN (US)

(73) Assignee: NORCO INDUSTRIES, INC., Compton, CA (US)

( * ) Notice: Subject to any disclaimer, the term of this patent is extended or adjusted under 35 U.S.C. 154(b) by 1 day.

(21) Appl. No.: 15/088,580

(22) Filed: Apr. 1, 2016

(65) Prior Publication Data

US 2017/0280954 A1 Oct. 5, 2017

(51) Int. Cl.
*A47L 5/16* (2006.01)
*A47L 5/36* (2006.01)
*A47L 9/06* (2006.01)

(52) U.S. Cl.
CPC ..... *A47L 5/365* (2013.01); *A47L 9/0626* (2013.01)

(58) Field of Classification Search
CPC ... A47L 5/365; A47L 5/18; A47L 5/14; A47L 7/0038; A47L 9/0626; A47L 7/2208; A47L 7/0042
See application file for complete search history.

(56) References Cited

U.S. PATENT DOCUMENTS 3,971,096 A * 7/1976 Renholt ..... A47L 5/18 15/326
4,845,802 A * 7/1989 Miller ..... A47L 7/0009 15/320
6,826,799 B2 * 12/2004 Smith ..... A47L 5/18 15/353
7,299,522 B1 * 11/2007 Smith ..... A47L 5/18 15/353

* cited by examiner

*Primary Examiner* — Dung Van Nguyen
(74) *Attorney, Agent, or Firm* — Fulwider Patton LLP

(57) ABSTRACT

A shop vac includes a handle, a canister, a vacuum tube, and a pick-up device. The canister holds an enclosure that generates a negative pressure by forcing compressed, high velocity air through a orifice plug and out a muffler to create a vacuum in the enclosure. The vacuum in the enclosure is transferred to the vacuum tube and the pick-up device to pick up liquid or debris on a shop floor. The enclosure inside the canister includes a flow control valve such as a ball in cage device to prevent fluid from entering the enclosure. An evacuation spout is located at the bottom of the canister for draining the vacuum when the canister becomes full.

12 Claims, 4 Drawing Sheets

SHOP VAC

BACKGROUND

Commercial shop vacuums, which are used in many automotive and industrial applications, are heavy duty vacuums that can be used to pick up materials that would not be suitable for ordinary house hold vacuums. For example, these "shop vacs" can pick up liquids, even viscous liquids, which make them particularly suitable for automotive repair and service facilities where oil and other fluids can be spilled on the floor. These shop vacs need to be light weight and easily maneuverable to clean up spills quickly and avoid dangers that can result from open puddles of fluid.

One such shop vac is disclosed in U.S. Pat. No. 6,826,799 to Smith, entitled COMPRESSED AIR VACUUM CLEANERS, the contents of which are incorporated herein by reference. Smith teaches a compressed air vacuum that attaches to an air hose and forces air down the handle. The air is then is forced through a venturi nozzle, which causes a negative pressure to occur. It has a baffle deflection piece that stops the liquid and debris from coming up into the venturi nozzle, thus allowing the debris and liquid material to be dropped back into the canister of the vacuum. The handle, venturi nozzle, and baffle are all one piece. The canister with the pick-up tube for sucking is a separate piece and then they snap together. The canister is removable from the handle piece for easy clean up.

While the above-mentioned vacuum is satisfactory for picking up light debris, it has a difficult time picking up larger items and heavier fluids. Thus, an improved compressed gas actuated shop vac is needed for today's modern automotive and industrial applications.

SUMMARY OF THE INVENTION

The present invention is a hand held shop vac that includes a handle, a canister, a vacuum tube, and a pick-up device. The canister holds an enclosure that generates a negative pressure by forcing compressed, high velocity air through a orifice plug and out a muffler to create a vacuum in the enclosure. The vacuum in the enclosure is transferred to the vacuum tube and the pick-up device to pick up liquid or debris on a shop floor. The enclosure inside the canister includes a flow control valve such as a ball in cage device to prevent fluid from entering the enclosure. An evacuation spout is located at the bottom of the canister for draining the vacuum when the canister becomes full.

Lab testing demonstrates that the high speed air stream exiting the nozzle acts to entrain air by the action of the pressure differential caused by the stream of high velocity air as it moves from the supply nozzle tip across the gap between the nozzle and the orifice plug opening. The high speed air also acts to "seal" the narrow orifice plug; thus preventing the vacuum chamber pressure from equalizing with atmospheric pressure through the muffler. The two primary factors related to vacuum generation relate directly to the orifice plug diameter and the air velocity. There is a definite increase in vacuum as the orifice plug diameter is decreased for the same air velocity. It should be noted that noise levels increase as the orifice plug opening narrows and/or the air velocity increases. However, exhaust air muffling may act to decrease the effectiveness of the vacuum generation.

The pick-up device of the present invention preferably comprises a pair of metal plates that contain two plastic wipers that form a gap there between where the vacuum is transmitted. The wipers extend beyond the plates and provide tapered channels that transmit the fluid or debris and resists clogging. A center support is located adjacent the vacuum tube juncture to prevent flexing of the wipers that can cause vacuum degradation.

These and other features of the present invention will best be understood with reference to the figures described below along with the detailed description of the invention.

DETAILED DESCRIPTION OF THE PREFERRED EMBODIMENTS

Figure 1:
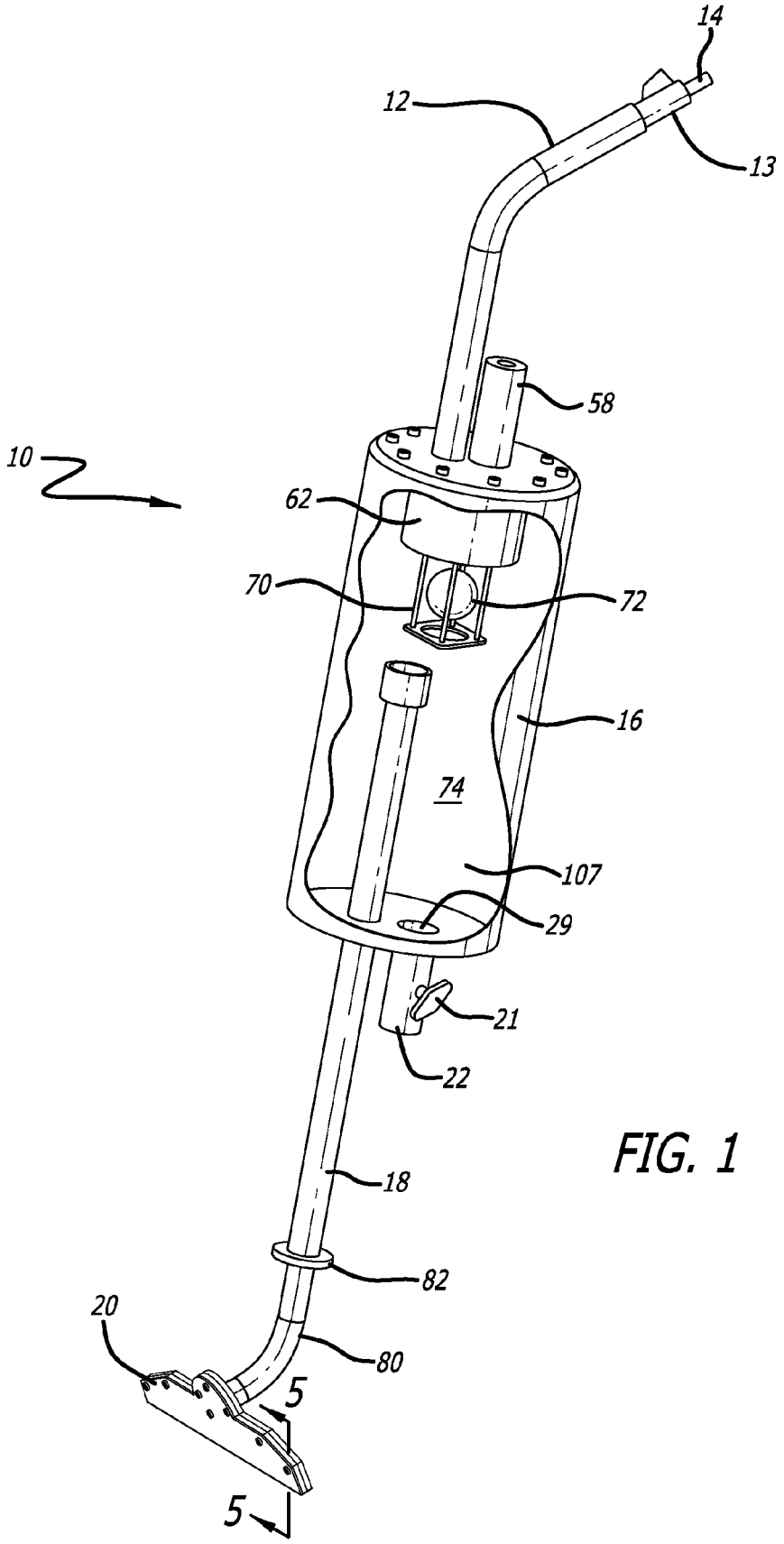
FIG. 1 an elevated, perspective view, partially cut-away, of a first preferred embodiment of the present invention.

FIG. 1 illustrates a first preferred improved shop vac of the present invention, generally denoted 10. The shop vac 10 comprises a handle 12 that includes at a top end an air fitting 13 that includes a jack 14 adapted to couple to an air supply hose (not shown) that delivers air under pressure as is found in most automotive facilities. The handle 12 is connected to a polyethylene plastic canister 16 having a cylindrical wall and upper and lower plates. Canister 16 is formed with cast-in threaded inserts, and upper and lower metal plates at each end bolt to the plastic canister via threaded inserts 61 (see FIG. 6). The connection between the canister 16 and the handle 12 at the upper plate is sealed using a vegetable fiber gasket to prevent loss of pressure at the juncture. At the opposite end of the canister 16 protruding through the bottom plate is a vacuum tube 18 that connects to a pick-up device 20, which also involves a gasket to prevent air leakage through this juncture. The canister 16 also includes a drain pipe 22 that can be used to drain the contents of the shop vac 10. When the canister 16 is to be drained, the knob 21 moves an occlusion to open the passageway 29 that allows fluid or debris to empty through the drain pipe 22.

Figure 6:
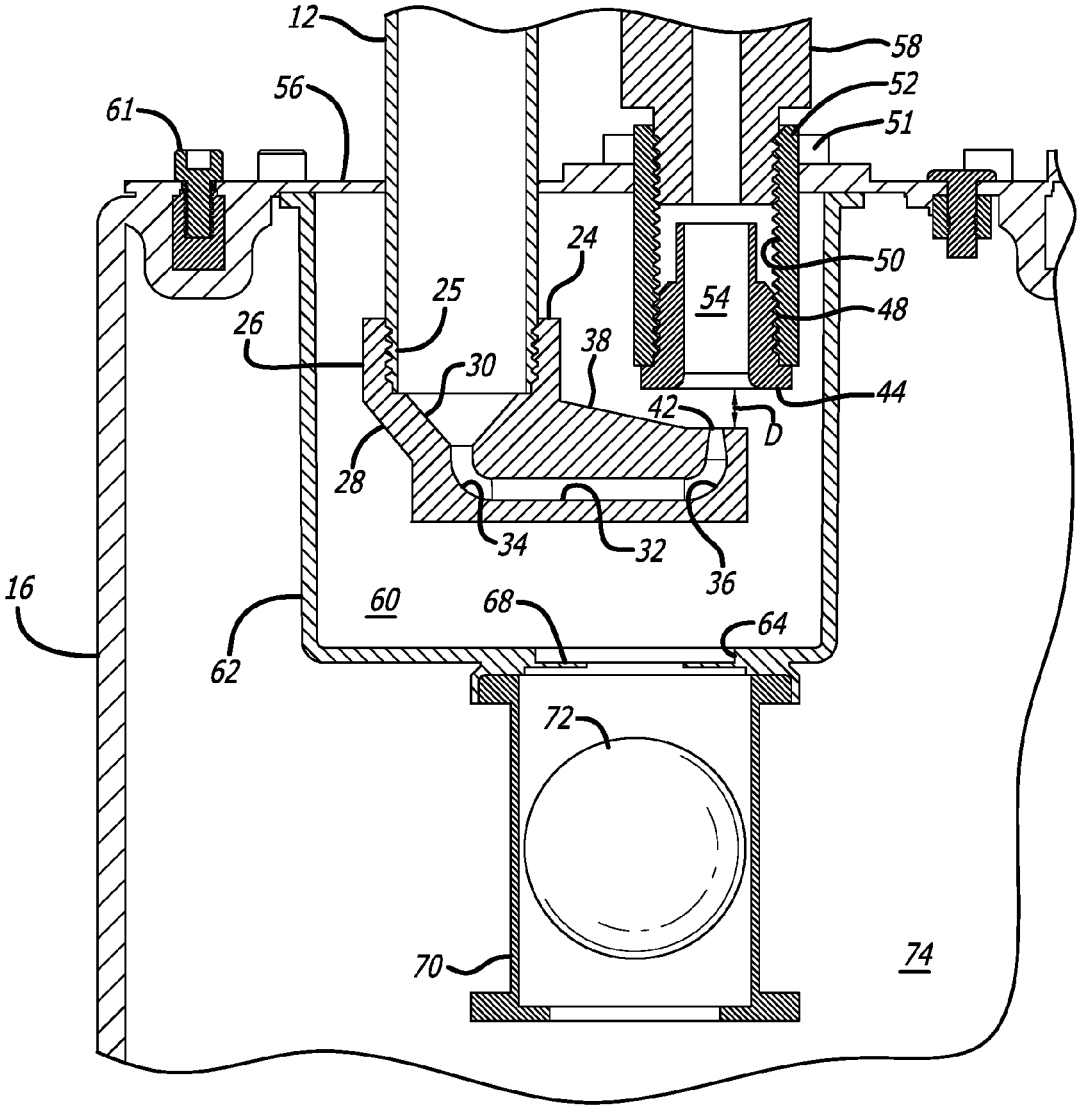
FIG. 6 is a cross-sectional view of the enclosure of the canister showing the orifice plug and fluid control valve.

FIG. 6 illustrates the interior of the shop vac 10 at the juncture with the handle 12. The handle 12 has an outer threading 25 that is used to connect the handle to a nozzle 24. Nozzle 24, which is preferably an ABS plastic, has internal threads that engage the outer threads 25 on handle 12 to form an airtight coupling of the handle 12 and nozzle 24. The coupling of the handle 12 and the nozzle 24 includes a sealant to ensure that the connection is airtight and can withstand the vibration of the system while permitting the components to be replaced or repaired if needed. The nozzle 24 has a cylindrical collar 26 on an upper portion and a conical portion 28 that encloses a funnel-like narrowing 30 of an airway leading from the handle 12. The funnel-like narrowing 30 leads to a cylindrical conduit 40 having a reduced air passage 32 that undergoes a first elbow 34 and a second elbow 36, each of approximately ninety degrees (90°), so that the airflow through the handle 12 is transitioned smoothly through a one hundred eighty degree change of direction within the nozzle 24. To combat the torque forces that are generated by the exiting air flow at the outlet 42, the nozzle 24 includes a reinforcing rib 38 that is disposed between the collar 26 and the outlet 42 to strengthen the nozzle, particularly at the juncture between the collar 26 and the conduit 40. As air is released through the outlet 42 of the nozzle 24, the resultant torque force would tend to be concentrated at the location where the rib 38 is located. The rib 38 therefore prevents cracking, warping, vibration, or other unwanted effects at the nozzle due to the force of the air at the outlet 42. In a preferred embodiment, the outlet 42 is further modified to add an additional area to boost air velocity and control volume of air delivered to orifice.

The outlet 42 of the nozzle 24 is opposed a orifice plug 44. The orifice plug 44 has a threaded outer surface 48 that engages a threaded inner surface 50 of a support tube 52 mounted on the canister 16. The support tube 52 can be locked on the canister 16 via a weld to a locking plate 51 at the upper surface 56 of the canister. Locking plate 51 is attached to the upper surface 56 of the canister 16 using four 10-32 screws. The orifice plug 44 has a cylindrical passage 54 axially aligned with the support tube 52, which extends through the upper surface 56 of the canister 16. A muffler 58 is threadedly engaged with the opposite end of the support tube 52 and extends out of the upper surface 56 of the canister 16. The upper surface 56 of the canister can be secured to the body of the canister by rivets or fasteners 61.

The pressurized air supply is connected to the handle such that high pressure air enters the handle 12 and is forced into the nozzle 24 and through the funnel-like narrowing 30. Here, the air accelerates due to the reduction of cross sectional area through the reduced air passage 32 and out outlet 42. This accelerated high velocity air moves out the outlet 42 and through the adjacent orifice plug's passage 54, which has a diameter of approximately 0.375-0.500 inches and is spaced from the outlet 42 at a gap "D" of between 0.25-0.5 inches. The air can be accelerated further by reducing the outlet area slightly using a narrowing at the exit. This passage of the high pressure air creates a low pressure region (the "venturi effect") in the volume defined by compartment 60 defined by enclosure 62 secured to the upper surface 56 about the nozzle 24, handle 12, orifice plug 44, and muffler 58. For typical shop compressed air supplies, the pressure is approximately ninety (90) psi directed through nozzle 24. The area of the outlet 42 is between 2-4 mm, although other dimensions are possible too due to the system supplying compressed air and its ability to supply the necessary volume given the opening size (which would tend to reduce the size of the outlet). The handle's internal passage has a cross sectional area of about 0.546 sq. in. based on an internal diameter of 0.834 inches. Using an average outlet diameter of 3 mm (~0.011 in) yields a cross sectional area of approximately 0.0109 square inches, resulting in a reduction of approximately 50:1. The ratio of handle to reduced passage area is approximately 50:1, boosting the velocity of the air prior to passage through the orifice plug 44. These conditions have been found to increase the vacuum in the enclosure 62 up to nine inches (9") of Hg.

The enclosure 62 has an opening 64 at the bottom that is connected to a positive ball-in-cage shut-off device 66 with a Viton® rubber or silicon seal 68 to withstand harsh chemicals. When a fluid level enters the cage 70 and reaches the ball 72, the fluid lifts the ball 72 up until the vacuum in the enclosure 62 pulls the ball 72 against the seal 68 in the round opening 64, and isolates tank portion 74 of the canister 16 from the enclosure's interior 60.

Figure 2:
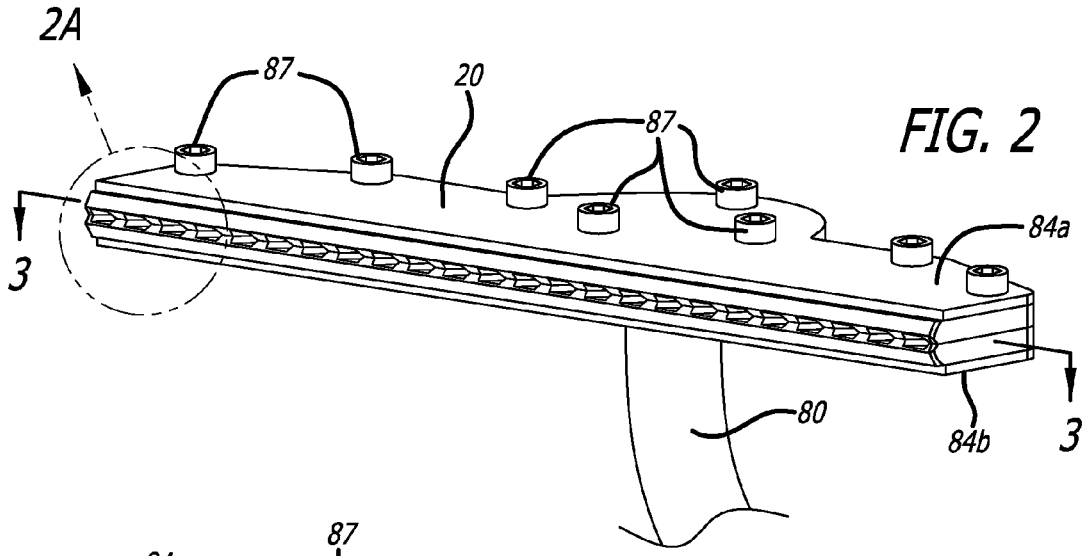
FIG. 2 is an enlarged, elevated view of the pick-up device of the embodiment of FIG. 1.
Figure 2A:
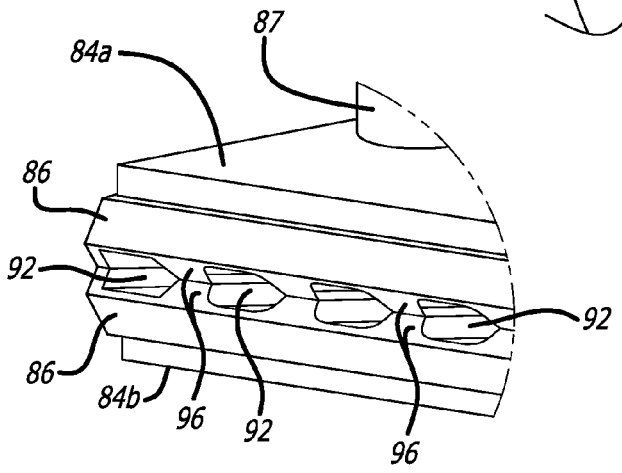
FIG. 2A is a section view of the wipers and plates that make up the front of the pick-up device.

FIGS. 2 and 2A illustrate the pick-up device 20, which includes a neck 80 that connects to the vacuum tube 18 at flange 82. The pick-up device 20 includes two metal plates 84*a,b* that are connected by a plurality of fasteners 87. Holes and fasteners 87 allow for the pick-up device 20 to be assembled first and then connected to the vacuum tube 18, and allows for quick replacement of any component of the pick-up device (plate, wiper, center support, etc.). Sandwiched between the two plates 84*a,b* are a pair of plastic flexible wipers 86 that protrude slightly below the plates 84*a,b* (see FIG. 4). The flexible wipers 86 mate easily together using cooperating pins and pin holes that lock the wipers in the correct position for incorporation into the pick-up device. The wipers 86 have angular tips or projections 88 that cooperate to form a V-shaped opening 90 along the length of the pick-up device 20 while maintaining a smooth and even contact with the floor surface. Each wiper 86 is formed with intermittent, aligned, expanding tapered channels 92 that allow debris and liquid to enter the pick-up device through the channels 92 and into the vacuum tube 80, and the tapering of the channels resists clogging at the ends of the channels 92. Channel walls 96 on each wiper prevent the channels 92 from collapsing under the vacuum pressure and maintain open passages for the collection of the debris and fluids. In a preferred embodiment, the angular projections 88 have rounded sides 99 so that the vacuum's pick-up device can be tilted while maintaining a reliable contact with the floor surface. The angular projections 88 ensure a smooth and continuous contact with the floor surface so that a vacuum is applied to the channels 92, such that the pick-up device can pick up liquid or debris.

Figure 3:
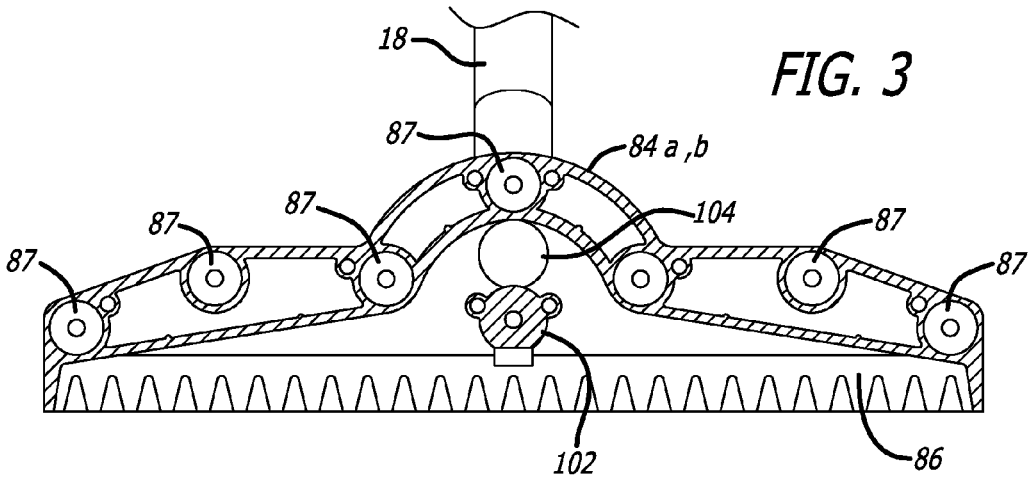
FIG. 3 is a cross-sectional view of the pick-up device of FIG. 2 taken along lines 3-3.
Figure 4:
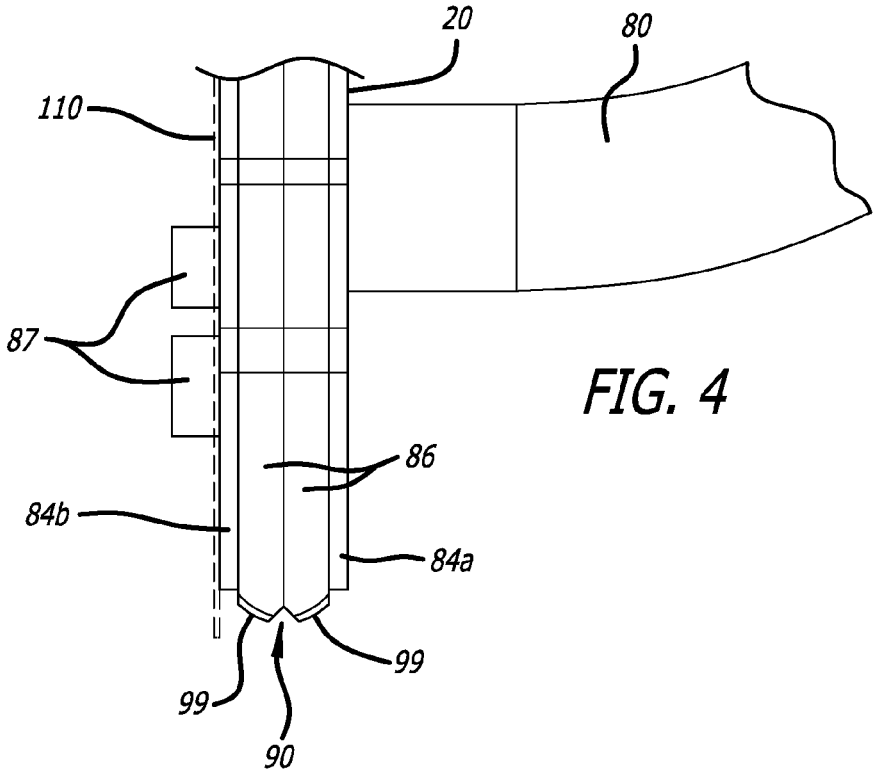
FIG. 4 is a sectional top view of the pick-up device of FIG. 2.
Figure 5:
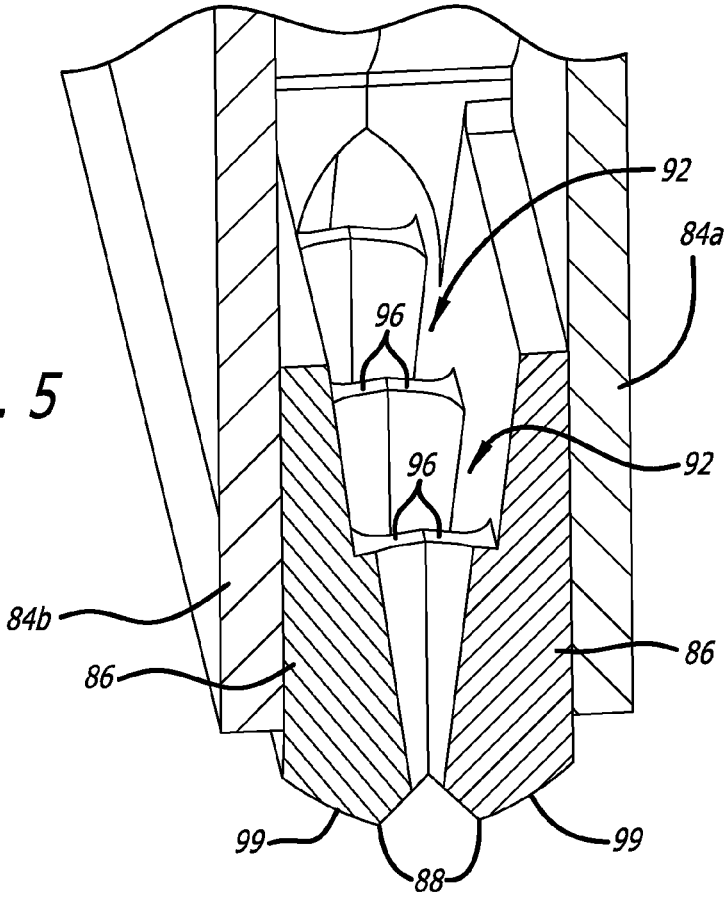
FIG. 5 is an enlarged, cross-sectional view in perspective of the wipers forming the tapered channels taken along line 5-5 of FIG. 1.

As shown in FIG. 3, a center support 102 is provided to prevent the middle portion of the wipers 86 from collapsing inward. That is, the vacuum pressure tends to warp or bend the wipers 86 inward toward the vacuum tube 18, but the positioning of the center support 102 fortifies the position of the wipers and prevents unwanted flex. The center support 102 is disposed between the pick-up device's opening 104 to the vacuum tube 18 and forces the center of the wipers 86 away from the opening 104 to ensure no flexing at the center region. Also, FIG. 4 illustrates (in shadow) an optional scraper 110 that can be fastened to the front surface of the pick-up device 20 to loosen debris or collect fluid or debris for vacuuming. In a preferred embodiment, the scraper plate is rigid and extends just below the protruding tips 88 of the wipers 86.

In operation, the adapter 13 is connected at jack 14 to a supply of high pressure air (not shown). The high pressure air is forced through the handle 12 and into the nozzle 24, where it is routed toward the venturi nozzle 24. The high pressure, high velocity air having been accelerated by the nozzle 24 enters the orifice plug and through the muffler 58. The passage of the air out the outlet 42 and through the orifice plug 44 creates a low pressure condition in the compartment 60. This continuous low pressure condition is communicated to the vacuum tube 18 and to the pick-up device 20, where the vacuum is present between the wipers 86. Fluid, dust, debris, and other materials are sucked through channels 92 in the wipers 86, and through the pick-up device and the vacuum tube 18. The debris, liquid, etc. collects in the canister 16 in a collection area 107 but cannot pass through the flow valve 70 due to the ball 72 protecting the entrance to the compartment 60. When the canister is full, the air supply is disconnected and the drain pipe 22 is opened via knob 21 to allow the contents of the canister to flow through to a waste bin or the like. The knob can then be returned to the closed position and further vacuuming can commence.

The foregoing descriptions and illustrations are intended to be exemplary and not limiting. That is, one of ordinary skill in the art would readily appreciate that modifications and substitutions are available without departing from the scope and spirit of the invention, and that the present invention is intended to include all such modifications and substitutions. Accordingly, the proper construction of the scope of the invention is the words of the appended claims, using their plain and ordinary meaning, in view of but not limited by the preceding descriptions and the illustrations included herewith.

I claim:

1. A vacuum connectable to a supply of compressed air, comprising:

a canister having an upper plate and a lower plate and a cylindrical wall;

a handle extending at a proximal end from the upper plate of the canister, the handle including an adapter at a distal end for connecting to a supply of pressurized air and a passage for communicating the pressurized air into the canister;

a nozzle within a compartment inside of the canister and connected to the handle for transferring the compressed air thereto, the nozzle accelerating the compressed air through a conduit with a smaller cross-sectional area than the handle;

an orifice plug inside the compartment and spaced from an outlet of the nozzle, the orifice plug passing the accelerated high pressure gas thereinthrough to create a low pressure condition in the compartment;

a muffler connected to the orifice plug and extending outside of the canister for expelling the high pressure air to the environment;

a flow control device for isolating the compartment inside the canister with a collection area inside the canister;

a drain pipe connected to the bottom plate of the canister, including a actuator for opening the drain pipe to empty contents collected in the collection area;

a vacuum tube extending from the canister at the bottom plate and in fluid communication with the collection area; and a pick-up device connected to the vacuum tube, the pick-up device including first and second plates and a flange connectable to the vacuum tube, and further comprising first and second wipers having a protruding tip that extends beyond the first and second plates, the protruding tips cooperating to form a V-shaped gap.

2. The vacuum of claim 1, wherein the V-shaped gap included tapered channels spaced along a length of the pick-up device, where the tapered channels are formed by cooperating surfaces of the first and second wipers.

3. The vacuum of claim 2, wherein a central portion of the protruding tip of the first and second wipers are biased downward by a central support member.

4. The vacuum of claim 3, further comprising a scraper plate removably secured to a front surface of the pick-up device, where the scraper plate extends just below the first and second protruding tips of the first and second wipers.

5. The vacuum of claim 2 wherein the flow control device is a ball and cage arrangement that prevents collected material from entering the compartment.

6. The vacuum of claim 1 wherein the wipers are plastic and are replaced by removing fasteners that connect the first and second plates.

7. The vacuum of claim 1, further comprising a reinforcing rib on the nozzle between a collar at the inlet and an outlet to strengthen the nozzle against a formation of stress concentrations and cracks.

8. The vacuum of claim 7 wherein the nozzle includes first and second elbows to redirect an airflow one hundred eighty degrees within the nozzle.

9. The vacuum of claim 8 wherein the handle and the nozzle have mating threads that engage to form an airtight relationship therebetween.

10. The vacuum of claim 1 wherein a spacing between a nozzle outlet and the orifice plug is between 0.25-0.50 inches.

11. The vacuum of claim 10 wherein a reduction in cross sectional area between the handle and the nozzle outlet is approximately 50:1.

12. A vacuum connectable to a supply of compressed air, comprising:

a canister having an upper plate and a lower plate and a cylindrical wall;

a handle extending at a proximal end from the upper plate of the canister, the handle including an adapter at a distal end for connecting to a supply of pressurized air and a passage for communicating the pressurized air into the canister;

a nozzle within a compartment inside of the canister and connected to the handle for transferring the compressed air thereto, the nozzle accelerating the compressed air through a conduit with a smaller cross-sectional area than the handle;

a muffler connected to the orifice plug and extending outside of the canister for expelling the high pressure air to the environment;

an orifice plug inside the compartment and spaced from an outlet of the nozzle, the orifice plug passing the accelerated high pressure gas thereinthrough to create a low pressure condition in the compartment, and the orifice plug is secured to a support tube that also supports the muffler;

a flow control device for isolating the compartment inside the canister with a collection area inside the canister;

a drain pipe connected to the bottom plate of the canister, including a actuator for opening the drain pipe to empty contents collected in the collection area;

a vacuum tube extending from the canister at the bottom plate and in fluid communication with the collection area; and a pick-up device connected to the vacuum tube, the pick-up device including first and second plates and a flange connectable to the vacuum tube.

* * * * *